United States Patent [19]

Huly et al.

[11] 4,112,862

[45] Sep. 12, 1978

[54] APPARATUS AND MEANS FOR PERMANENTLY MARKING A BUOYANT MINE WHICH HAS BEEN SEVERED FROM ITS MOORING WIRE DURING MINE SWEEPING OPERATIONS

[75] Inventors: William Huly, Stratford; Rudolph G. Brouillette, Milford, both of Conn.

[73] Assignee: United Technologies Corporation, Hartford, Conn.

[21] Appl. No.: 154,242

[22] Filed: Jun. 11, 1971

[51] Int. Cl.[2] ..... B63B 9/00; B63B 51/00; B63B 51/02; B63B 21/60

[52] U.S. Cl. ..... 114/221 R; 114/221 A; 9/9; 102/15

[58] Field of Search ..... 114/221, 221 A; 9/9; 102/7.6, 15

[56] References Cited

U.S. PATENT DOCUMENTS

| | | | |
|---|---|---|---|
| 1,094,700 | 4/1914 | Bundgens | 114/221 A |
| 2,806,442 | 9/1957 | Temple | 114/221 A |
| 3,097,373 | 7/1963 | Wisti | 9/9 |
| 3,499,411 | 3/1970 | Savoie | 9/9 X |

*Primary Examiner*—Samuel W. Engle
*Assistant Examiner*—Thomas H. Webb
*Attorney, Agent, or Firm*—Vernon F. Hauschild

[57] ABSTRACT

A frangible container is pivotally connected to the sweep wire of mine sweeping equipment so as to intercept the mine mooring wire passing therealong and be pivoted thereby so as to connect thereto during the pivot motion and to be severed as the mooring wire continues to pass along the sweep wire, thereby providing a force to sever the frangible container to allow release of its tethered marker for floating to the surface with the buoyant mine when the mooring wire is severed, following the marker releasing operation.

14 Claims, 4 Drawing Figures

INVENTORS
WILLIAM HULY
RUDOLPH G. BROUILLETTE
BY Vernon F. Hanschell
ATTORNEY

APPARATUS AND MEANS FOR PERMANENTLY MARKING A BUOYANT MINE WHICH HAS BEEN SEVERED FROM ITS MOORING WIRE DURING MINE SWEEPING OPERATIONS

BACKGROUND OF THE INVENTION

1. Field of Invention

This invention relates to the sweeping of buoyant mines which are moored by a mooring wire from an anchor on the bottom of a body of water and which float beneath the surface of the water and are actuated by influence signature and/or upon contact with a ship hull, and more particularly to mechanism for permanently marking a floating mine which has been severed or cut from its mooring during the mine sweeping operation.

2. Description of the Prior Art

In the mine sweeping art, attempts have been made to mark mines which have been released during the mine sweeping operation to insure that the location of the released mine is clearly identified for avoidance and/or destruction by others in the future, and to further insure that the sweeping vessels avoid the vicinity of the released mine when resweeping the area. These efforts have included dropping floatable mechanism, such as buoys, near a newly released mine during the sweeping operation, placing a chemical dye or the like in the water near the newly released mine, and the use of other vicinity identifying mechanisms and methods in which the mine and the identifying mechanism are not connected. Unfortunately, due to the unpredictable actions of different floating devices in turbulent waters, the unconnected marker frequently floats away from the location of the floating mine which it was initially marking.

Other devices, such as that taught in U.S. Pat. No. 2,524,863, cause the mine and its mooring mechanism to be connected to the mine sweeping vessel so as to be towed thereby from the stern thereof to insure that the whereabouts of the swept mine is known at all times. Substantial problems are encountered in dragging the intercepted mine mooring mechanism so that the utility of the sweeping vessel is seriously impaired for further sweeping until the mine mooring mechanism can be released.

Other devices, such as that taught in U.S. Pat. No. 1,582,388 to Elia teach connecting a marker to the mine anchor mechanism but permitting the mine to float free, thereby failing to accomplish the navigational safety objective of this invention.

SUMMARY OF INVENTION

A primary object of the present invention is to permanently mark a floating mine which has been released during a mine sweeping operation to insure that its whereabouts is thereafter easily detectable at all times, either during the daytime or night.

In accordance with the present invention, convenient marker mechanisms are attached in tethered fashion to the severed mooring wire of the floating mine to float therewith after release of the mine from its anchor.

In accordance with this invention, a frangible container enveloping a tethered marker is pivotally connected to the sweep wire of a mine sweeping rig and is oriented to intercept the floating mine mooring wire which may pass therealong during the sweeping operation, to cause the container to pivot from its initial intercepting position to a second position in which the mooring wire connects to the frangible container so that further relative motion between the sweeping wire and the mooring wire will cause the frangible container to separate and release the tethered marker to float to the surface and remain in the vicinity of the mine when the mine mooring wire is cut or severed at a point below the attachment of the container.

In accordance with a further aspect of the present invention, severed or swept mine location identifying means can be carried with conventional mine sweep equipment for sweeping therewith and for marking all mines released during the sweeping operation, and such that the sweeping operation can continue in safety and unencumbered following release of mines in the earlier portions of the sweeping operations.

BRIEF DESCRIPTION OF THE DRAWINGS

FIG. 2 shows the mechanism attached to the sweep wire and in the position it will assume prior to contact thereof by the mine mooring wire.

FIG. 3 is similar to FIG. 2 but shows our mine marker mechanism immediately after it has attached to the mine mooring wire.

FIG. 4 is similar to FIGS. 2 and 3 and shows our mine marker mechanism after the frangible portions thereof have separated and with the marker carrying portion thereof connected to the mine mooring wire, while the remainder thereof remains connected to the sweep wire.

Referring to FIG. 1 we see mine sweeping streaming gear mechanism 10 attached to towing vehicle 12. Tow cable 14 projects from vehicle 12 in any convenient fashion and connects to mine sweep gear 16 by hook 18. Mine sweep gear 16 includes lead wire 20, port sweep wire 22 and starboard sweep wire 24, which coact to form a Y. Floats *26a-26e* are connected to the various wires as shown to mark the location thereof and keep the sweep wires a preset distance below the surface of the water. Otters or depressors *28a-28e* serve to assure the depth and spread at which the sweep wires are drawn through the water. One or more of our mine marking mechanism *30a-30d* are connected to sweep wires 22 and 24 and, in a manner described in greater particularity hereinafter, connect to the mine mooring wire and float to the surface therewith after the tethered marking material has been released so that the marking agent remains with the released mine on the surface of the water at all times.

Referring to FIGS. 2–4 we see our mine marking mechanism 30 in greater particularity and see the sequence of its operation. Mine marking mechanism 30 is oriented in the armed position shown in FIG. 2 during normal sweeping operation and prior to the time that it is contacted by the mine mooring wire 32. Marker mechanism 30 includes frangible container 34, which includes sections 36 and 38 connected at frangible joint 40. Frangible container 34 is pivotally connected at pivot joint 42 to fin member 44 so as to be pivotable between its normal, streaming, armed position shown in FIG. 2 and its mine mooring cable capture position shown in FIGS. 3 and 4. Spring mechanism 46, which is preferably of the coil type, envelopes pivot joint 42 and abuts container 34 and stop member 48 to cause marking container 34 to assume its FIG. 2 position during normal streaming operation.

Figure 1:
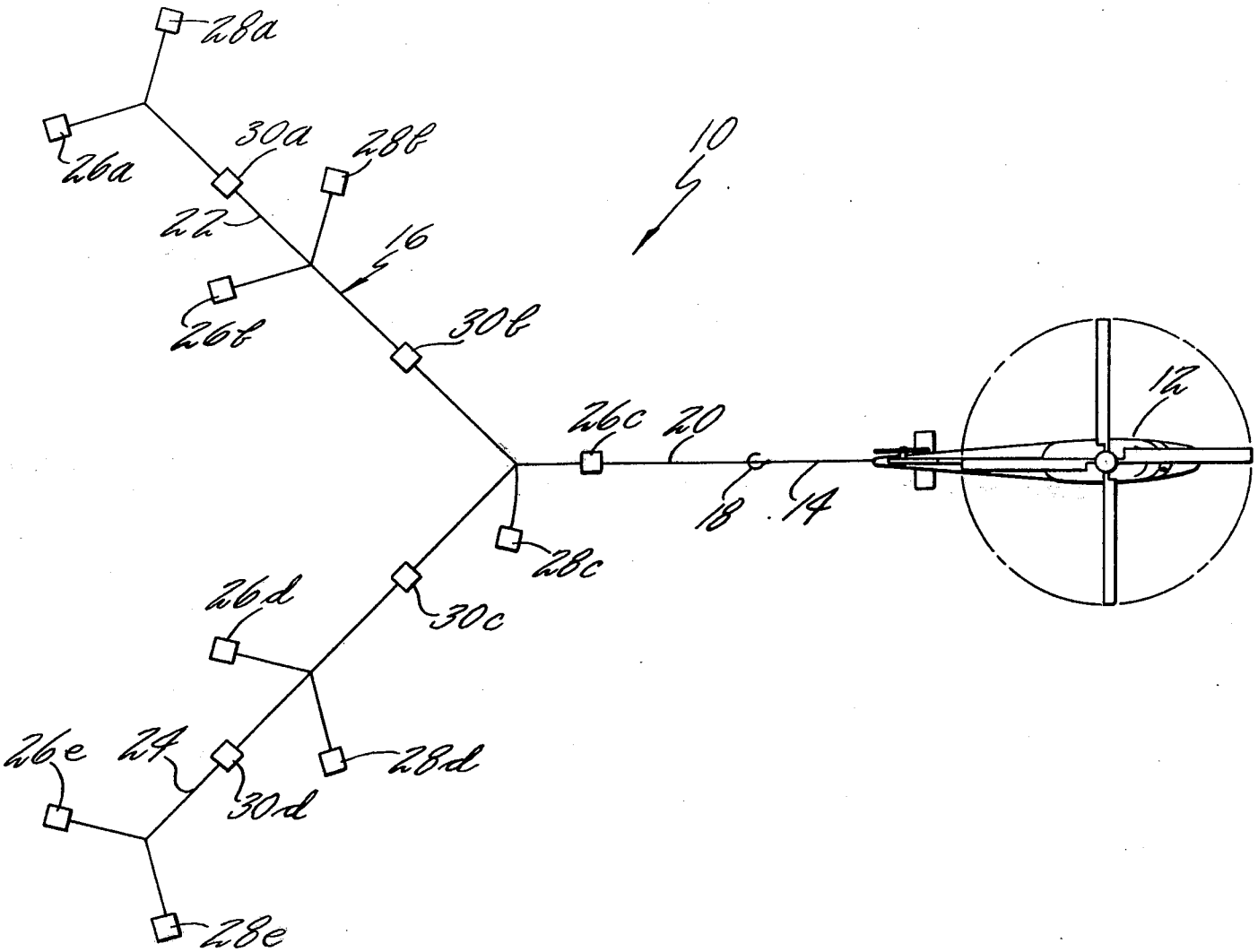
FIG. 1 is a schematic showing of a vehicle towing conventional mine sweeping gear in streaming formation and illustrates the environment of our invention.

Hook mechanism 50 is connected to portion 36 of container 34 in any convenient manner and is oriented so as to form an acute angle with wire 22 so as to intercept the mine mooring cable 32 as described hereinafter. Latching spring mechanism 52, which consists of latch spring 54 having one end thereof permanently positioned in retainer 56 and the other end thereof temporarily constrained in its FIG. 2 position during the normal mine sweeping operation by retainer block 58. Release wire 60 extends, as shown in FIG. 2, between the end of hook 50 and into release block 58 to retain the release block in its FIG. 2 latching spring locked position during normal streaming operation.

Container 34 may be of any shape but, to insure its proper operation, we have made it so that it is substantially rectangular in cross section and includes an easily removable container lid or side 35, which forms one side of the container and has tabs, such as 37 projecting therefrom and through slots, such as 39, in the other walls of container 34. To insure its frangibility or separability, portion 36 and 38 of container 34 are made of light gauge metal or plastic and are joined by perforated joint 40.

Figure 2:
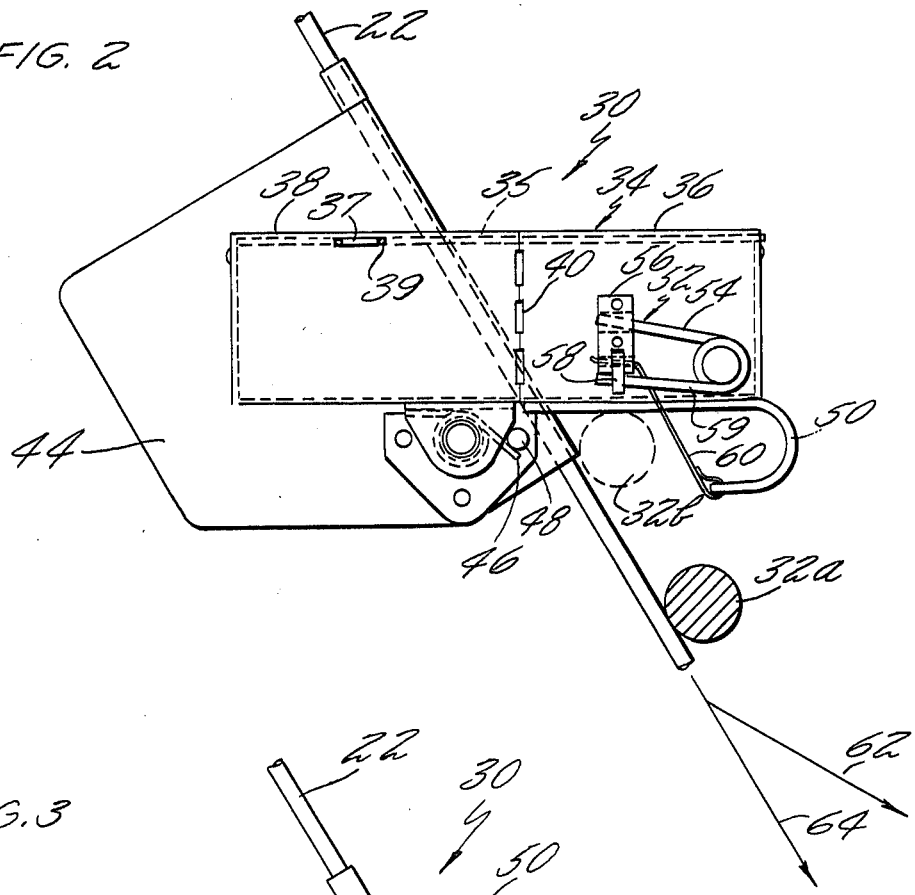
FIGS. 2–4 are sequential showings of the operation of our mine marker mechanism.

Fin 44 serves to maintain marking mechanism 30 in both a trailing and horizontal attitude such that hook 50 will be in proper orientation (as shown in FIG. 2) to intercept the wire 32.

By way of explanation of the operation of our marking mechanism, it should be noted that sweep wire 22 is towed, as shown in FIG. 2, to travel in the direction of arrow 62 prior to contact with mooring cable 32 and will travel in the direction of arrow 64 after contact with the mine mooring cable 32. As best shown in FIG. 2, mine mooring wire 32 is shown to have contacted sweep wire 22 at its position designated as **32*a*. As the sweep wire 22 continues to be drawn through the water, the mooring wire assumes position 32*b*, due to the relative motion between wires 22 and 32. While, in fact, the mooring wire 32 is actually fixed in position and the sweep wire 22 is the only moving wire, from a relative motion standpoint; for pictorial and descriptive purposes, it can nonetheless be stated that mooring wire 32 passes along sweep wire 22**, or vice versa.

With mooring wire in its **32*b* position, it has just made contact with marking container 34. As the sweep wire 22 continues to pass along the mooring wire to its position shown in FIG. 3 as 32*c*, it has caused container 34 to pivot from its FIG. 2 normal streaming and armed position to its FIG. 3 attaching position. In passing from the FIG. 2 to the FIG. 3 positions, mooring cable 32 has entered hook 52, and depressed release wire 60 thereinto so as to free retainer block 58 and hence the retained end 59 of latch spring mechanism 52, thereby permitting it to spring to its FIG. 3 position and lock mooring wire 32 into hook 50. Accordingly, FIG. 3 depicts our marking mechanism 30 in an intermediate operating position wherein latch spring mechanism 52 and hook 50 are cooperating to connect frangible container 34 to mine mooring wire 32 but the container 34** remains intact with the tethered marker mechanism retained therein.

Figure 3:
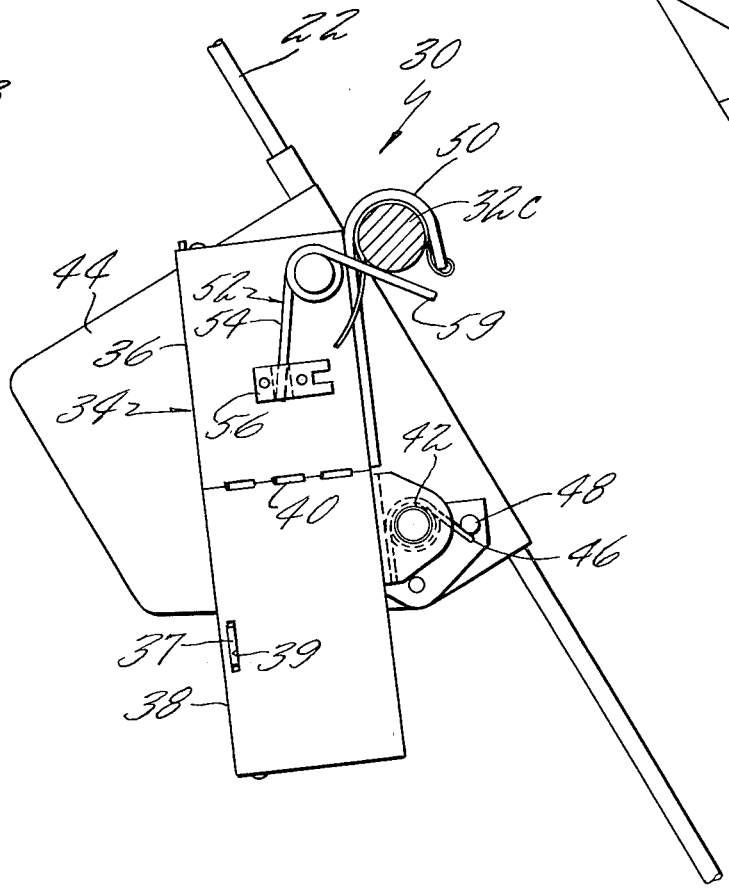
Figure 4:
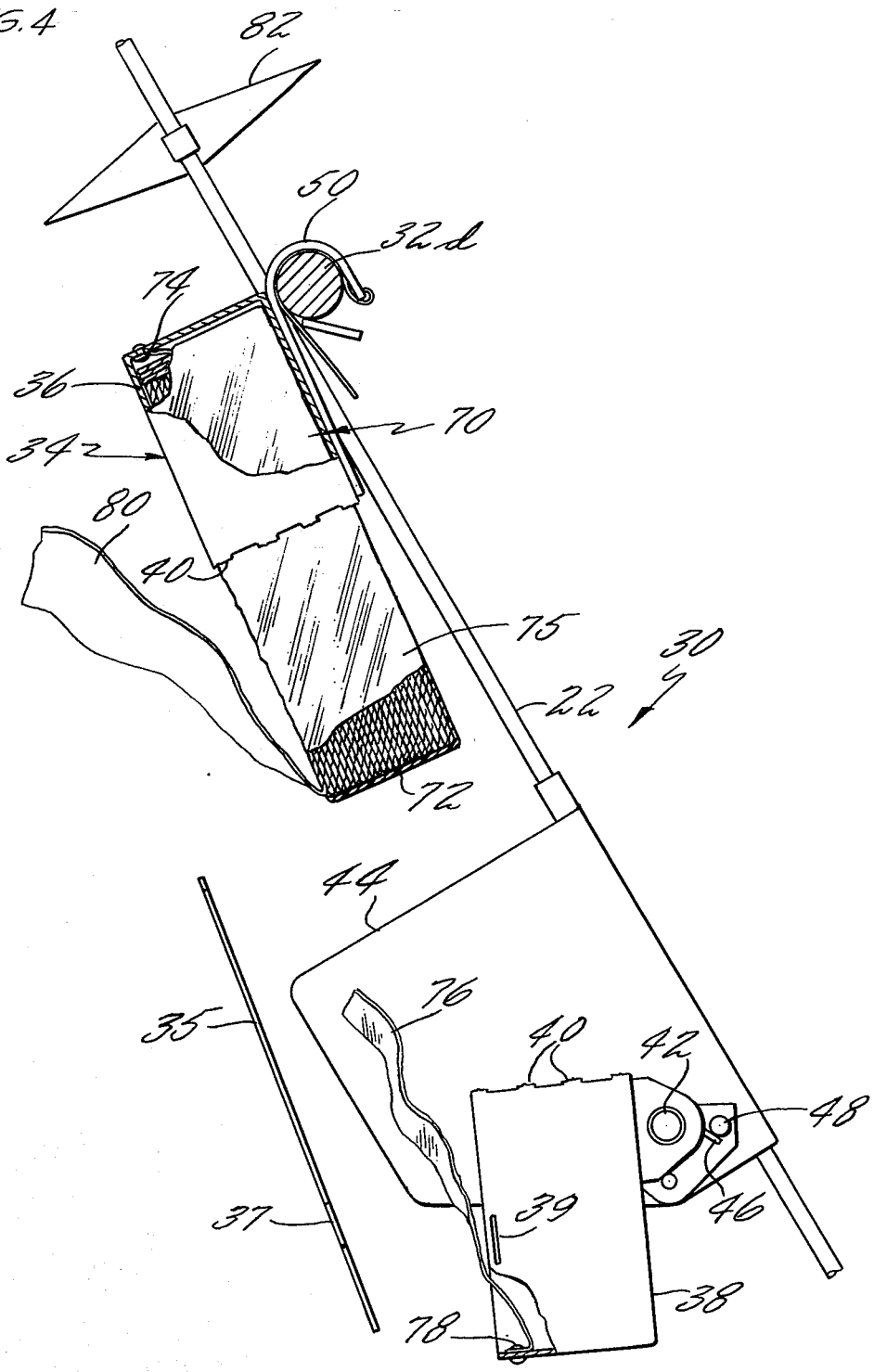

As mooring wire 32 continues to move along sweep wire 22 from its FIG. 3 to its FIG. 4 position, and with portion 36 of frangible container 34 connected to the mooring wire 32, while portion 38 thereof remains connected to the sweep wire 22, the force of the towing vehicle towing the streaming gear 10 through the water causes frangible container 34 to sever along its frangible or perforated joint 40, thereby freeing container lid 35 to more readily free the tethered and enveloped marking agent shown generally at 70. The tethered marking agent 70 preferably includes a nylon tethering line 72 which connects at point 74 to container portion 36. Nylon envelope 75 normally envelopes the marking agent 80 and includes a tear strip 76 which is connected at point 78 to container portion 38. As container portions 36 and 38 separate, tear strip 76, in rip cord fashion, opens nylon envelope 75 to free tethering line 72, and marking agent 80. Marking agent 80 can be of any conventional type which preferably has both day and night visibility and/or audibility, such as a buoyant brilliant tape, a light beacon, a radio beacon, or a long term chemical dye release mechanism.

Accordingly, as shown in FIG. 4, our frangible container 34 has been opened so that the marking agent 80, tethered from container portion 36 by tether line 72, is freed from the interior of container 34 and envelope 75, and is connected to the mine mooring cable 32 as at station **32*d***.

As the mooring cable 32 continues to move from its FIG. 4 position along the sweep wire 22, it engages a conventional cable cutter mechanism 82, which is preferably attached to sweep wire 22 and may be of the type MK 17 MOD O, which serves to sever the mooring cable 32 at a station on the opposite side of hook 50 from the mine proper. With the mooring cable 32 so severed, the buoyant mine will carry both the mooring cable 32 and the marking mechanism portion 36 to the surface of the water where the marking agent 80 will float connected at all times by tether line 72 to severed mooring cable 32 and hence the buoyant mine.

Our invention is equally applicable to the marking of mines which may be so designed as to maintain a position below the surface of the water when not moored, as well as for those which exhibit positive buoyancy and rise to the water surface upon release from a mooring.

We wish it to be understood that we do not desire to be limited to the exact details of construction shown and described, for obvious modifications will occur to a person skilled in the art.

We claim:

1. Apparatus for marking a buoyant mine which has been severed from its mooring wire during mine sweeping operations including:

(A) multi-piece container mechanism, (B) means to pivotally connect said container mechanism to the sweep wire of mine sweeping gear so as to be pivotable from a first position wherein said container mechanism will intercept a mine mooring wire to a second position by the force of the sweep wire passing along the mooring wire wherein said container is attached to the mine mooring wire, (C) hook means operatively connected to said container means and positioned to receive the mine mooring wire therein as said container means moves from said first to said second positions, (D) means to lock the mooring wire in said hook so that as the sweep wire continues to pass along the mooring wire, said multi-piece container mechanism will separate with at lease one portion thereof connected to said hook, (E) means to sever the mooring wire at a location therealong on the opposite side of said hook from the mine to thereby permit the mine to float to the surface of the water carrying said hook and said portion of the container connected thereto therewith, and (F) marker means positioned in said container mechanism and connected to said portion thereof which is attached to the hook to thereby mark the buoyant mine and its wire so severed.

2. Apparatus according to claim 1 wherein said multipiece container mechanism includes a frangible joint between the portions thereof and with one portion thereof pivotally connected to the sweep wire by said connecting means and the other portion thereof supported therefrom through said frangible joint and carrying said hook means and said marker means so as to be carried to the surface of the water with the severed buoyant mine.

3. Apparatus according to claim 1 wherein said lock means is responsive to the movement of the mooring wire into said hook.

4. Apparatus according to claim 1 wherein said marking means is tethered to said other portion of said container mechanism and includes means to cause said marking means to commence to be payed out from said other portion of said container mechanism.

5. Apparatus according to claim 1 and including means to cause said container mechanism to assume said first position so as to define a selected angle with the sweep wire to intercept a mooring wire passing therealong.

6. Apparatus according to claim 2 wherein said container mechanism is of substantially rectangular cross section including three joined sides defining an open side and including a container cover separate from said three sides and joined thereto in tab-slot reception fashion so as to be easily removable therefrom, and including means to connect said marker means to said container mechanism in the form of a selectively coiled line attached to the portion of the mechanism which is attached to the hook, and further including an envelope member enveloping said coiled line and having a tear strip along the side thereof connected to the other portion of said container so that separation of said container portions will cause said tear strip to open said envelope and release said coiled line.

7. Apparatus for permanently marking a buoyant mine which has been severed from its mooring wire during mine sweeping operations including:

(A) a separable container mechanism including:

(1) a first portion adapted to be pivotally connected to the sweeping wire of mine sweeping mechanism, (2) a second portion supported from said first portion to be pivotable therewith between a first position wherein the container mechanism is oriented to intercept a mine mooring wire and to be rotated thereby to a second position and including:

(a) a hook member connected to said second container portion and adapted to receive the mooring wire therein as the mooring wire causes said container mechanism to pivot between said first and second positions, (b) locking means to lock the mooring wire in the hook so that as the sweep wire continues to pass along the mooring wire said container mechanism portions will be caused to separate, (c) marker means connected by tether fashion to the interior of the container second portion, and (B) means to sever the mooring wire so connected to said hook at a location on the opposite side of the hook from the mine so that the mine may float to the surface of the water carrying the severed mooring wire, container second portion, and marking means therewith.

8. Apparatus according to claim 7 wherein said first portion and said second portion of said separable container mechanism are joined by a perforated joint.

9. Apparatus according to claim 8 wherein said locking means is responsive to the motion of the hook member passing onto said mooring wire, 10. Apparatus according to claim 9 wherein said wire locking means includes a locking spring connected to said container mechanism second portion adjacent said hook member, means to retain said locking spring in a recoiled position during normal operation, and means to release said locking spring when the mooring wire enters the hook member.

11. Apparatus according to claim 7 wherein said marking means is tethered to said second portion of said container mechanism and includes means to cause said marking means to commence to be payed out from said second portion of said container mechanism in response to container portion separation.

12. Apparatus according to claim 7 and including means to cause said container mechanism to assume said first position so as to define a selected angle with the sweep wire to intercept a mooring wire.

13. Apparatus for marking a buoyant mine which has been severed from its mooring wire during mine sweeping operations including:

(A) frangible container mechanism, (B) means to pivotally connect said container mechanism to the sweep wire of mine sweeping mechanism so as to be pivotable between a first position wherein said container mechanism will intercept a mine mooring wire and to be pivoted by the force thereof to a second position, (C) means operatively connected to said container mechanism to positively connect said container mechanism to the mooring wire as said container mechanism pivots so that as the sweep wire continues to pass along the mooring wire, said frangible container mechanism will separate with a portion thereof connected to the mooring wire through said connecting means, (D) means to sever the mooring wire at a location therealong on the opposite side of said connecting means from the mine to thereby permit the mine to float to the surface of the water carrying said portion of the container connected thereto therewith, and (E) marker means positioned in said container mechanism and connected to said portion thereof which is attached to the mooring wire to thereby mark the buoyant mine.

14. Apparatus for marking a buoyant mine which has been severed from its mooring wire during mine sweeping operations including:

(A) separable container mechanism, (B) means to connect said container mechanism to the sweep wire of mine sweeping mechanism so as to be oriented to intercept a mine mooring wire, (C) means operatively connected to said container mechanism to positively connect said container mechanism to the mooring wire so that as the sweep wire continues to pass along the mooring wire, said separable container mechanism will separate with a portion thereof connected to the mooring wire through said connecting means, (D) means to sever the mooring wire at a location therealong on the opposite side of said connecting means from the mine to thereby permit the mine to float to the surface of the water carrying said portion of the container connected thereto therewith, and (E) marker means positioned in said container mechanism and connected to said portion thereof which is attached to the mooring wire to thereby mark the buoyant mine.

* * * * *